US006321409B1

(12) United States Patent
Libman

(10) Patent No.: US 6,321,409 B1
(45) Date of Patent: Nov. 27, 2001

(54) STRING MOP AND CONNECTOR THEREFOR

(76) Inventor: Robert Libman, 909 W. University, Champaign, IL (US) 61821

( * ) Notice: Subject to any disclaimer, the term of this patent is extended or adjusted under 35 U.S.C. 154(b) by 0 days.

(21) Appl. No.: 09/516,828

(22) Filed: Mar. 1, 2000

(51) Int. Cl.[7] ..... A47L 13/20; A47L 13/255

(52) U.S. Cl. ..... 15/229.2; 15/145; 15/147.1; 248/74.3

(58) Field of Search ..... 15/144.3, 145, 15/147.1, 228, 229.1, 229.2, 229.6; D32/50, 51, 52; 248/73, 74.3, 71, 74.2; 24/16 BB

(56) References Cited

U.S. PATENT DOCUMENTS

| | | | |
|---|---|---|---|
| 1,147,174 | * | 7/1915 | Johnson . |
| 1,924,978 | | 8/1933 | Bullis . |
| 2,299,480 | | 10/1942 | Horsley . |
| 3,463,427 | | 8/1969 | Fisher . |
| 3,516,124 | | 6/1970 | Merser . |
| 3,886,962 | | 6/1975 | Diamontis . |
| 3,947,140 | | 3/1976 | Thomas . |
| 3,966,154 | | 6/1976 | Perrault et al. . |
| 4,135,272 | | 1/1979 | Stephenson . |
| 4,179,632 | | 12/1979 | Harvell . |
| 4,247,216 | * | 1/1981 | Pansini . |
| 4,377,879 | | 3/1983 | Christo . |
| 4,572,466 | | 2/1986 | Yamaguchi et al. . |
| 4,783,873 | | 11/1988 | Young . |
| 4,793,646 | * | 12/1988 | Michaud . |
| 4,819,293 | * | 4/1989 | Nicholson . |
| 4,995,134 | | 2/1991 | Monahan . |
| 5,135,188 | | 8/1992 | Anderson et al. . |
| 5,343,587 | * | 9/1994 | Findley . |
| 5,345,643 | * | 9/1994 | Tomm . |
| 5,375,286 | | 12/1994 | Harrah . |
| 5,537,719 | | 7/1996 | Freed . |
| 5,548,864 | * | 8/1996 | Vosbikian et al. . |
| 5,581,850 | | 12/1996 | Acker . |
| 5,704,097 | | 1/1998 | Rahav . |
| 5,816,543 | | 10/1998 | Kraus . |

FOREIGN PATENT DOCUMENTS

| | | | |
|---|---|---|---|
| 1238157 | | 6/1988 | (CA) . |
| 549142 | | 6/1993 | (EP) . |
| 2191937 | | 12/1987 | (GB) . |
| 2191937-A | * | 12/1987 | (GB) . |
| 2255712-A | * | 11/1992 | (GB) . |
| 2264256 | | 8/1993 | (GB) . |

* cited by examiner

*Primary Examiner*—Terrence R. Till
(74) *Attorney, Agent, or Firm*—Marshall, Gerstein & Borun

(57) ABSTRACT

A mop has a handle and a mop head including a set of mop fibers attached to a connector. The connector includes a strap extending from a base plate. The strap includes a molded curved section between an end and a section of relatively flexibility. The end of the strap includes barbs that allow it to be anchored to a slot in the base plate, binding the mop fibers in place. The connector has a rigid stem that fits within an open lower end of a broom handle. The stem includes a button on a deformable web, which seats in a sidewall aperture on the handle to releasably secure the connector to the handle.

17 Claims, 3 Drawing Sheets

FIG. 4
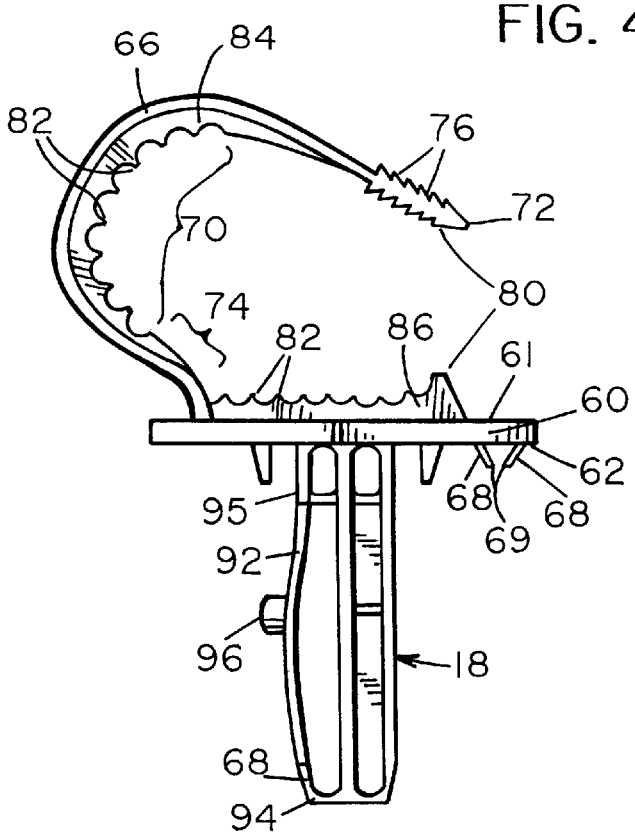
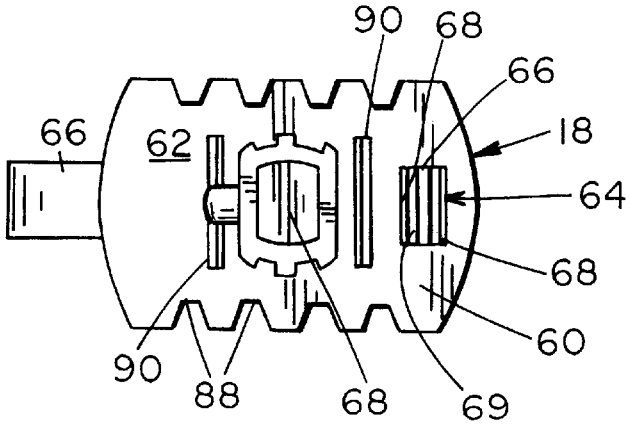
FIG. 5
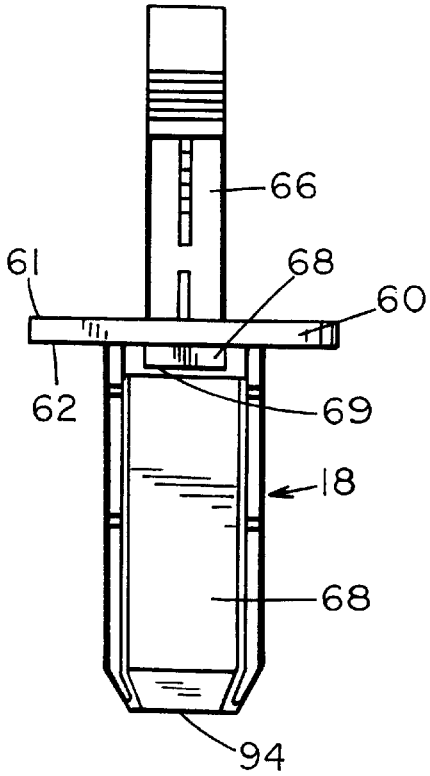
FIG. 6

STRING MOP AND CONNECTOR THEREFOR

CROSS-REFERENCE TO RELATED APPLICATIONS

Not applicable.

STATEMENT REGARDING FEDERAL SPONSORSHIP

Not applicable.

BACKGROUND OF THE INVENTION

The invention relates generally to mops, and more particularly to mops in which a connector is used to connect mop fibers to a handle.

U.S. Pat. No. 1,924,978 discloses an early version of a cleaning product with a separate connector used to secure a "dusting element" to a handle. In that device, the connector (head H) is illustrated as being attached to the handle ferrule 5 that is anchored to the handle by a pin 6 or the like. The connector includes two deformable arms 2 that are used to hold the dusting element. The dusting element includes an internal casing or envelope 7 with a central opening 8, through which the arms can pass when squeezed together. After the arms are inserted into the casing or envelope, they can be released to hold the dusting element in place. Unfortunately, the device appears to require an internal casing or envelope, which could be unduly expensive for use with a mop.

U.S. Pat. No. 2,299,480 shows a more conventional method for attaching mop fibers to a handle. The illustrated mop head includes a U-shaped wire loop 11 that has pointed ends 13 that can be used to pierce a cylindrical ferrule 12. The completed head can be attached to a handle by a driving a nail through a hole 14 in the ferrule.

U.S. Pat. No. 4,135,272 discloses a more modem implementation of the idea. That discloses a plastic connector 12 having an aperture 27 and slot 29 used for securing fibers to the head. A separate strap 34 having a head 35 is first passed through the aperture 27, then under the mop fibers, then up through the slot 29. The head holds one end of the strap in the aperture 27, while projecting teeth 38 hold the other end in the slot 29. The connector includes an upper cylindrical portion 14 that permits it to be threaded onto a handle 18.

U.S. Pat. No. 4,377,879 discloses a one-piece mop connector comprising a tongue 16 that can be used to hold mop fibers. The tongue can be locked in place by a series of grips 18 that can engage locking members 22 molded onto the sides of the connector. The connector is secured to a handle through the seating of an interior retaining projection 28 in a groove 30 on the end of the handle. This semi-permanent connection of the connector to the handle is not particularly desirable.

In apparent recognition of the need for improving the security of the connection of a connector to a handle, while permitting easy replacement or exchange of a mop head, U.S. Pat. No. 5,375,286 discloses a resilient bayonet-type mounting system for cleaning implements. The disclosed mop head apparently traps mop fibers between distinct upper and lower elements 9 and 10 that are secured together by ultrasonic welding.

A simpler and more convenient connector for attaching mop fibers to a mop handle would be desirable.

BRIEF SUMMARY OF THE INVENTION

This invention provides a significant improvement over the prior art. Like prior mops, the mop uses a connector to connect mop fibers to a handle. Unlike prior mops, however, the connector is a simple single piece that can hold the mop fibers and be releasably secured to the handle in distinct operations.

For holding mop fibers, the connector includes a strap that extends from an end plate. The end of the strap can be secured to the plate at a strap anchorage, encircling the fibers and holding them in place.

For securing the connector to the handle, the connector includes a stem projecting from the end plate. The stem fits within an open lower end of the handle, and can be secured in place by engagement of a button in a sidewall aperture in the handle. The button is formed on a deformable web that extends between an opposed end of the stem and either the inner end of the stem or the end plate. The web enables the button to be depressed, releasing the connector from the handle.

The combination of these elements in an easy-to-fabricate, single-piece connector enables the manufacture of a low-cost mop that is is simple to manufacture and easier to assemble, disassemble, and reassemble than previously-known mops. Further advantages of the invention should be apparent to those skilled in the art upon reviewing the following detailed description in conjunction with the accompanying drawings, in which:

BRIEF DESCRIPTION OF THE DRAWINGS

FIG. 4 is an elevational view of the connector of the mop of FIG. 1;

FIG. 5 is a bottom view of the connector of FIG. 4; and

FIG. 6 is a side view of the connector of FIG. 4;

DETAILED DESCRIPTION OF THE INVENTION

Figure 1:
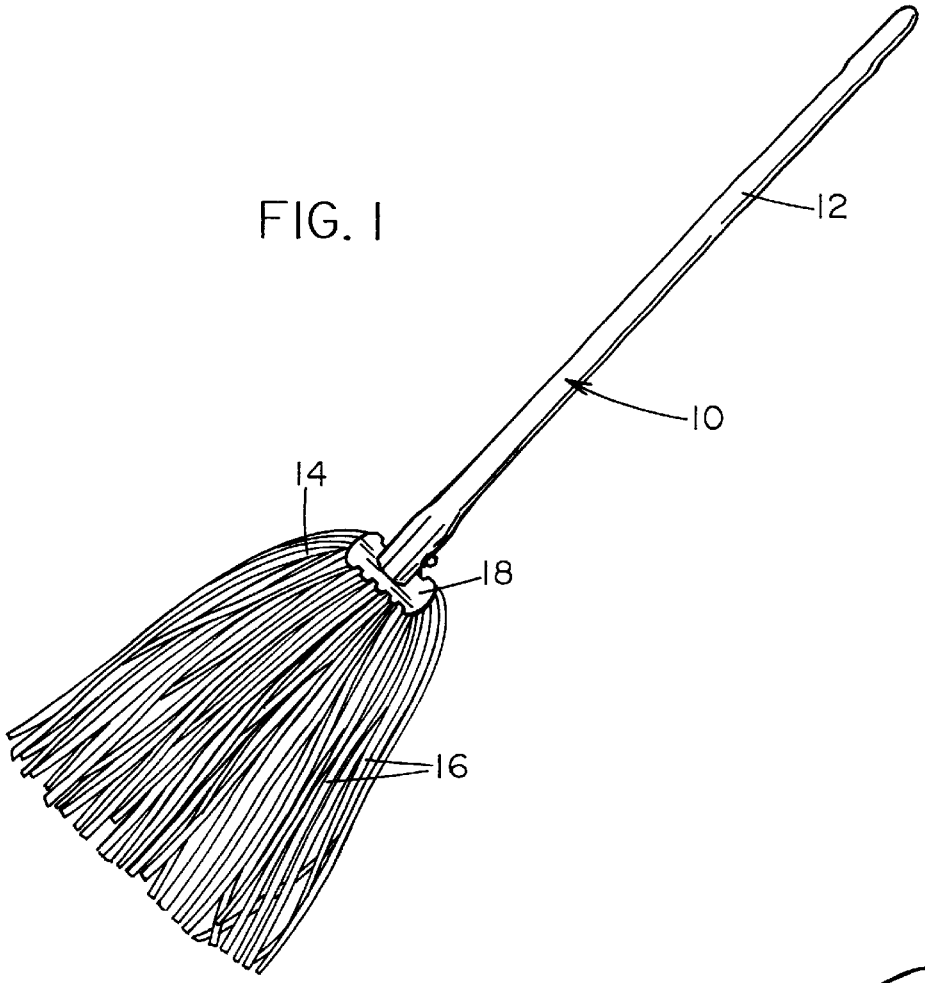
FIG. 1 is a perspective view of a mop in accordance with an embodiment of this invention.

One embodiment of the mop that is the subject of this invention is shown in FIG. 1. The components of the mop 10 are a handle 12 and a mop head 14. The mop head is comprised of mop fibers 16 and a connector 18.

Figure 2:
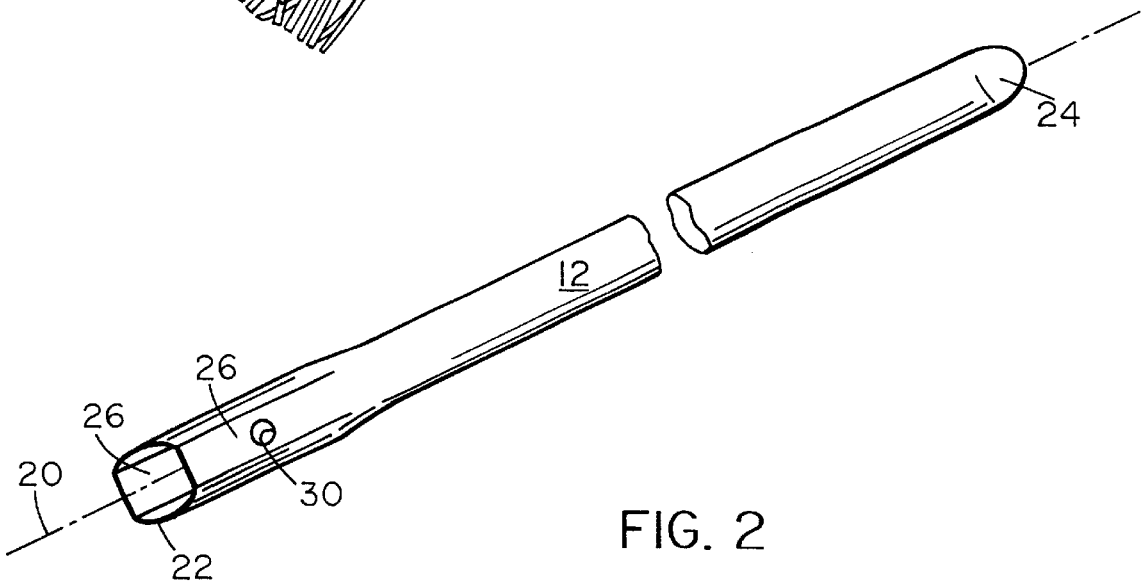
FIG. 2 is a fragmentary side view of the handle of the mop of FIG. 1.

As seen in FIG. 2, the handle 12 has a central axis 20, an open lower end 22, and a handle end 24. The handle can be made of any conventional material (such as plastic, metal, or wood), and have any conventional or convenient length and configuration. While the illustrated handle is a straight steel handle having a diameter of approximately 1' and opposed planar or crimped faces 26 at the open lower end, it could also have one or more bends or curves for added convenience or ease of use, or have a different diameter or opening configuration. The handle could also have a shaped handgrip, such as those shown in U.S. Pat. Nos. D346,946 and D346,543. The open lower end of the handle has a sidewall aperture 30. As illustrated, the sidewall aperture is circular, has a diameter of approximately ¼ inch, and is centered approximately ⅞ of an inch from the lower edge 32 of the lower open end. The exact size and position of this aperture could vary.

Figure 3:
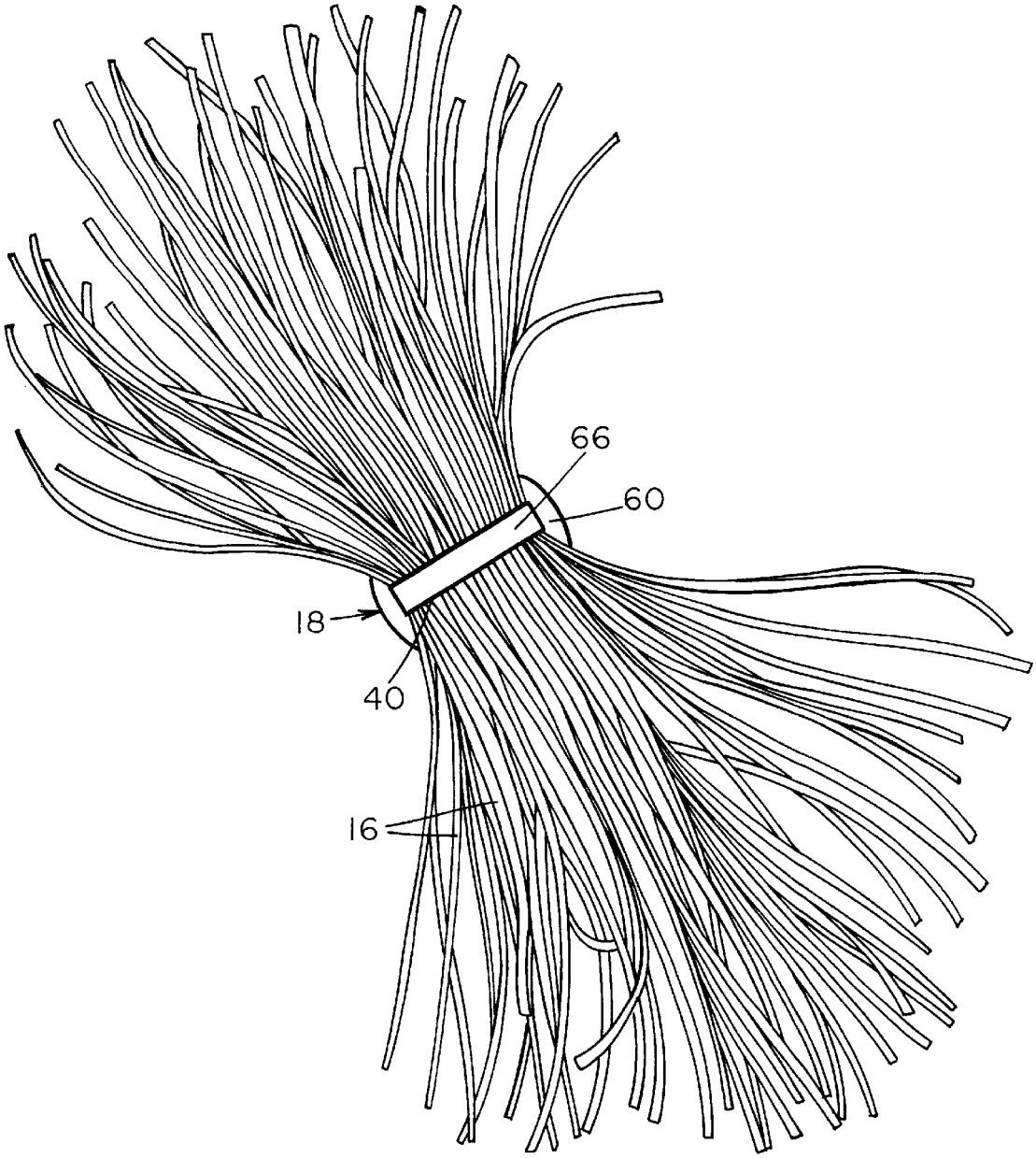
FIG. 3 is an end view of the mop, with the mop fibers arranged to provide a view of strap.

The mop fibers 16, seen in FIG. 3, can be of any conventional or convenient material. As illustrated, the fibers are approximately 2-foot long strands of fabric or yarn, such as cotton yarn. Each strand has a midpoint 40 that is anchored to the connector 18.

FIGS. 4–6 show the connector before mop fibers are attached. The connector 18 has a base plate 60 with a top surface 61, a bottom surface 62, and a strap anchorage 64. Extending from the base plate are a strap 66 and a rigid stem 68. The illustrated connector 18 is made of molded plastic, although other materials could also be used.

The illustrated strap 66 extends upwardly from the top surface 61 of the connector 18 while the stem 68 extends downwardly from the bottom surface 62. The illustrated strap anchorage 64 comprises a slot 66 in the base plate 60 (best seen in FIG. 5) and a pair of locking walls 68 extending beneath the slot. Other kinds of strap anchorages could also be used. The illustrated slot is approximately ½ inch long and approximately 3/16 of an inch wide at the top surface of the base plate 60. The illustrated locking walls extend downwardly approximately 3/16 of an inch below the bottom surface of the base plate, are angled toward each other, and have lowermost edges 69 that are about 1/16 of an inch apart. Other configurations could also be used.

As illustrated in FIG. 4, the strap 66 is about ⅜ of an inch wide and includes a central curved section 70 between an end 72 and a section of relative flexibility 74 near the base plate 60. As illustrated, relative flexibility of the section of the strap near the base plate is provided by the strap having reduced thickness in this section. The illustrated strap is only approximately 1/16 of an inch thick in the section of relative flexibility, compared to approximately 3/32 of an inch thick in the central curved section.

The end 72 of the strap 66 is provided with a means for anchoring the strap at the strap anchorage 64. The illustrated means is a series of barbs 76, although other means could also be used. The illustrated barbs are extend from both sides of the strap, and are approximately ⅛ of an inch wide.

The mop head 14 is created by squeezing the midpoint 40 of the mop fibers 16 between the strap 66 and the base plate 60. To do this, the midpoint of the fibers can first be pressed into the central curved section 70 of the strap through the initial opening 80 between the end 72 of the strap and the base plate. Spikes 82 on a ridge 84 on the inside surface of the strap and on a ridge 86 on the top surface 61 of the base plate can help to hold the mop fibers in position. The illustrated spikes are approximately 1/16 of an inch high on 1/16 inch thick ridges. After the fibers are positioned, the end of the strap can be pressed into the strap anchorage 64, where the barbs 76 engage the locking walls 68 to permanently lock the fibers in position.

As illustrated, the ridge 86 on the base plate 60 is higher near the strap anchorage 70 than it is near the strap section of relative flexibility 74. The increased height of the ridge near the strap anchorage helps to keep the mop fibers 16 from migrating toward the strap anchorage as the end 72 of the strap is moved toward the strap anchorage. Keeping the mop fibers away from the strap anchorage can be useful because the fibers could otherwise interfere with engagement of the end of the strap into the strap anchorage. The base plate illustrated in FIG. 5 also comprises notches 88 around at least a portion of its periphery. These notches also help to maintain the mop fibers in position.

The rigid stem 68 projecting from the bottom surface 62 of the base plate 60 of the connector 18 is used to secure the connector to the handle 12 of the broom. The illustrated stem is approximately 2 inches long and, as seen in FIG. 5, has a cross-sectional shape configured to fit snugly within the open lower end 22 of the handle. The illustrated connector also includes shoulders 90 on the bottom surface of the base plate. When the connector is mounted on the handle, these shoulders engage the opposed planar or crimped faces 26 on the handle, providing additional support and preventing rotation of the connector with respect to the handle.

A deformable web 92 extends between an opposed end 94 of the stem 68 and one of an inner end 95 of the stem and the base plate 60. The web includes a button 96 that projects away from the stem. The web and button are configured so that when the stem is disposed into the open lower end of the handle 12, the button seats in the sidewall aperture 30, securing the connector 18 to the handle.

The resiliency of the web 92, and its configuration, allow a user to press it inwardly to release the mop head 14 from the handle when desired. To achieve this, the illustrated web is about one inch long, approximately ¼ of an inch wide, approximately 1/16 of an inch thick, and is disposed at least about ⅛ of an inch from the stem 68. The illustrated button 96 has a circular cross section, a diameter of about ¼ of an inch, and is about 3/16 of an inch high. Other configurations could also be used.

This description of one embodiment of a mop has been only a description of the invention. Those skilled in the art will appreciate that many modifications can be made to the disclosed embodiment without departing from the spirit or scope of the invention, which is set forth in the following claims.

What is claimed is:

1. A mop head comprising mop fibers and a one-piece connector, the connector comprising:

a base plate with a strap anchorage;

a stem projecting from the base plate and having an opposed end;

a deformable web extending between the opposed end of the stem and one of an inner end of the stem and the base plate;

a button on the web, projecting away from the stem; and a strap extending from the base plate with an end anchored at the strap anchorage.

2. A mop head as recited in claim 1, in which the strap end is anchored in the strap anchorage, and mop fibers pass between the strap and the base plate.

3. A mop comprising the connector of claim 1.

4. A mop as recited in claim 3, in which:

the mop further comprises a handle with an open lower end and a sidewall aperture near the lower end;

the stem of the connector is disposed within the open lower end of the handle; and the button on the web of the connector is seated in the sidewall aperture of the handle to releasably secure the connector to the handle.

5. A mop as recited in claim 3, in which:

the mop further comprises a handle with an open lower end; and the connector and the open lower end of the handle comprise means for preventing rotation of the connector with respect to the handle.

6. A mop as recited in claim 3 in which:

the mop further comprises a handle with an open lower end; and the open lower end of the handle has opposed planar faces.

7. A mop as recited in claim 3, in which:

the mop further comprises a handle with an open lower end;

the open lower end of the handle has opposed planar faces, and the connector has a lower surface that has shoulders engaging the planar faces of the open lower end of the handle.

8. A mop head as recited in claim 1, in which the connector comprises spikes on the top surface of the base plate.

9. A mop head as recited in claim 1, in which:

the connector is made of plastic;

the web is at least about one inch long, approximately ¼ of an inch wide, approximately 1/16 of an inch thick, and is disposed at least about ⅛ of an inch from the stem;

the button projects about 3/16 of an inch from the web.

10. A mop head as recited in claim 1, in which the strap comprises a section of relative flexibility near the base plate.

11. A mop head as recited in claim 1, in which the strap anchorage comprises a slot in the base plate and the means for anchoring the strap comprises a barb.

12. A one-piece connector comprising:

a base plate with a strap anchorage;

a stem projecting from the base plate and having an opposed end;

a deformable web extending between the opposed end of the stem and one of an inner end of the stem and the base plate;

a button on the web, projecting away from the stem; and a strap extending from the base plate and having an end anchored at the strap anchorage, a concave inside surface, and spikes on the concave inside surface of the strap.

13. A connector comprising:

a base plate with a strap anchorage;

a stem projecting from the base plate and having an opposed end;

a deformable web extending between the opposed end of the stem and one of an inner end of the stem and the base plate;

a button on the web, projecting away from the stem; and extending from the base plate and having a section of relative flexibility near the base plate, an end comprising means for anchoring the end at the strap anchorage, and a molded curved section between the end of the strap and the section of relative flexibility.

14. A plastic connector comprising:

a base plate with a strap anchorage;

a stem that projects from the base plate and has an opposed end;

a deformable web that extends between the opposed end of the stem and one of an inner end of the stem and the base plate;

a button on the web that projects away from the stem; and a strap that extends from the base plate and has both an end that comprises means for anchoring the end at the strap anchorage and a section of reduced thickness near the base plate.

15. A connector comprising:

base plate with a strap anchorage that comprises a slot in the base plate and a locking all extending beneath the slot;

a stem that projects from the base plate and has an opposed end;

a deformable web that extends between the opposed end of the stem and one of an inner end of the stem and the base plate;

a button on the web that projects away from the stem; and a strap that extends from the base plate and has an end that comprises a barb.

16. A connector comprising:

a base plate with a strap anchorage and notches around at least a portion of its periphery;

a stem that projects from the base plate and has an opposed end;

a deformable web that extends between the opposed end of the stem and one of an inner end of the stem and the base plate;

a button on the web that projects away from the stem; and a strap that extends from the base plate and has an end that comprises means for anchoring the end at the strap anchorage.

17. A connector comprising:

a base plate with a strap anchorage and a raised projection adjacent the strap anchorage;

a stem that projects from the base plate and has an opposed end;

a deformable web that extends between the opposed end of the stem and one of an inner end of the stem and the base plate;

a button on the web that projects away from the stem; and a strap that extends from the base plate and has an end that comprises means for anchoring the end at the strap anchorage.

* * * * *

UNITED STATES PATENT AND TRADEMARK OFFICE

CERTIFICATE OF CORRECTION

PATENT NO. : 6,321,409 B1
DATED : November 27, 2001
INVENTOR(S) : Robert Libman et al.

It is certified that error appears in the above-identified patent and that said Letters Patent is hereby corrected as shown below:

Column 5,
Line 4, -- stem; and -- should replace "stem;"
Lines 41 and 42, -- and a strap extending -- should replace "and extending"

Column 6,
Line 12, -- wall -- should replace "all"

Signed and Sealed this

Third Day of December, 2002

JAMES E. ROGAN
*Director of the United States Patent and Trademark Office*